US006837650B2

(12) United States Patent
Magee et al.

(10) Patent No.: US 6,837,650 B2
(45) Date of Patent: Jan. 4, 2005

(54) SPLIT DRUM FOR A COMPACTING WORK MACHINE

(75) Inventors: Kevin J. Magee, Buffalo, MN (US); Clint W. Paulson, Brooklyn Park, MN (US); Dean R. Potts, Maple Grove, MN (US); Federico B. Rio, Minneapolis, MN (US)

(73) Assignee: Caterpillar Paving Products Inc, Minneapolis, MN (US)

( * ) Notice: Subject to any disclaimer, the term of this patent is extended or adjusted under 35 U.S.C. 154(b) by 0 days.

(21) Appl. No.: 10/321,190

(22) Filed: Dec. 17, 2002

(65) Prior Publication Data

US 2004/0114998 A1 Jun. 17, 2004

(51) Int. Cl.[7] ..... E01C 19/26
(52) U.S. Cl. ..... 404/132; 404/122
(58) Field of Search ..... 404/122, 132, 404/128, 117; 180/247–250, 341, 371; 74/61, 87

(56) References Cited

U.S. PATENT DOCUMENTS 4,632,599 A * 12/1986 Sadahiro ..... 404/124
4,841,810 A * 6/1989 Lew ..... 475/165
5,390,495 A 2/1995 Lemaire
6,561,729 B1 * 5/2003 Potts ..... 404/117

OTHER PUBLICATIONS

Hamm—DV–6—Operating and Service Manual, Edition 04 83, HAMM Walzenfabrik GmbH, D–8593 Tirschenreuth/ West–Germany, pp. Cover, Model Cover Page, letter Page, Eng. Drawing.

U.S. patent application, application No. 10/020,148, filed Dec. 14, 2001, entitled "Compacting Drum for a Work Machine", Dean R. Potts.

* cited by examiner

*Primary Examiner*—Thomas B. Will
*Assistant Examiner*—Raymond W Addie
(74) *Attorney, Agent, or Firm*—Jeff A Greene

(57) ABSTRACT

A split drum is provided for a compacting work machine and includes a first and a second drum section. A differential arrangement is operatively positioned between the first and second drum sections. Rotational power is supplied to the first and second drum sections through the differential arrangement which is connected with a propel motor. The first and second drum sections are rotated simultaneously by grounding either the first or second drum section with the propel motor. Releasing the grounding allows the first drum section to counter rotate relative to the second drum section.

14 Claims, 4 Drawing Sheets

SPLIT DRUM FOR A COMPACTING WORK MACHINE

TECHNICAL FIELD

The invention relates generally to asphalt and soil compacting work machines, and more particularly to a split drum for such work machines.

BACKGROUND

Compacting work machines are commonly employed for compacting freshly laid asphalt, soil, and other compactable substrates. For example these work machines may include plate type compactors or rolling drum compactors with one or more drums. The drum type work machines function to compact the material over which the machine is driven. In order to more efficiently compact the material the drum assembly often includes a vibratory mechanism for inducing vibratory forces on the material being compacted.

It is common practice in the compacting of asphalt to use work machines that include two rotating drums to more efficiently compact the material. Double drum compactors are used so that during each pass over the material being compacted each drum performs a portion of the compacting process. These double drum compactors either have an articulating frame or each drum has the ability to pivot about a vertical axis so that the work machine can be steered in a desired direction during operation. During tight turning operations the portion of the drum that is radially outward of the turn can slide over the material being compacted. This sliding can cause a tear in the material because the portion of the drum that is radially outward of the turn desires to rotate faster than the inner portion. On the other hand the inner portion of the drum can plow or mound the asphalt because the tendency is for the inner portion of the drum to rotate slower than the outside portion. Both of the above-described tendencies are contrary to the goal of finishing a road surface that is smooth and flat.

A solution in an attempt to minimize the problem set forth above is to provide a drum that has first and second drum sections known as a split drum. The split drum divides the width of a given drum in half allowing an outer drum section to rotate faster than an inner drum section during turning operations. Split drum designs are known in the art and often use a fixed friction pack to couple the two drum sections to one another. The frictional force of the friction packs must be overcome however before slip can occur between the drum sections. In operation however these split drums do not always operate in a predictable manner and slip between the sections occurs when not desired and often does not occur when slip is desired. Another attempt to address this problem is disclosed in U.S. Pat. No. 5,390,495 granted on Feb. 21, 1995 and assigned to Poclain Hydraulics. This patent teaches having first and second drum sections that are coupled together by a brake arrangement and using independent drive motors to propel each drum section.

The present invention is directed at overcoming one or more of the problems as set forth above.

SUMMARY OF THE INVENTION

In one aspect of the present invention, a split drum for a compacting work machine is provided. The split drum includes a first drum section and a second drum section positioned adjacent to the first drum section. A differential arrangement operatively connects the first drum section and the second drum section.

In yet another aspect of the present invention, a method for driving a split drum for a compacting work machine the split drum having a first drum section and a second drum section. The method includes driving the first and the second drum sections of the split drum, with an output of a propel motor, through a differential arrangement. Grounding a one of the first drum section and the second drum section with the output of the propel motor rotates the first and second drum sections in unison.

DETAILED DESCRIPTION

Figure 1:
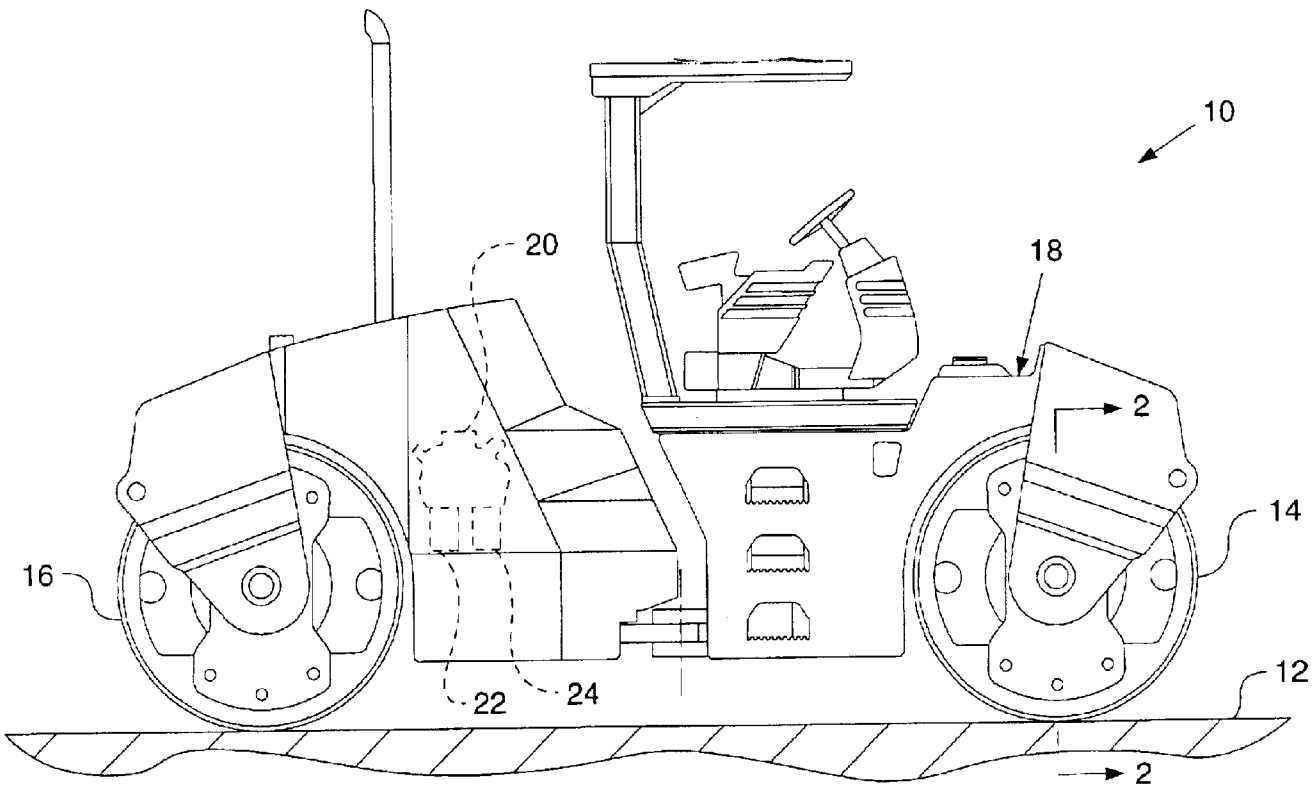
FIG. 1 is a side elevational view of a work machine embodying the present invention.

A work machine 10, for increasing the density of a compactable material or mat 12 such as soil, gravel, or bituminous mixtures is shown in FIG. 1. The work machine 10 is for example, a double drum vibratory compactor, having a first/front compacting drum 14 and a second/rear compacting drum 16 rotatably mounted on a main frame 18. The main frame 18 also supports an engine 20 that has a first and a second power source 22,24 conventionally connected thereto. Variable displacement fluid pumps or electrical generators can be used as interchangeable alternatives for the first and second power sources 22,24 without departing from the present invention.

Figure 2:
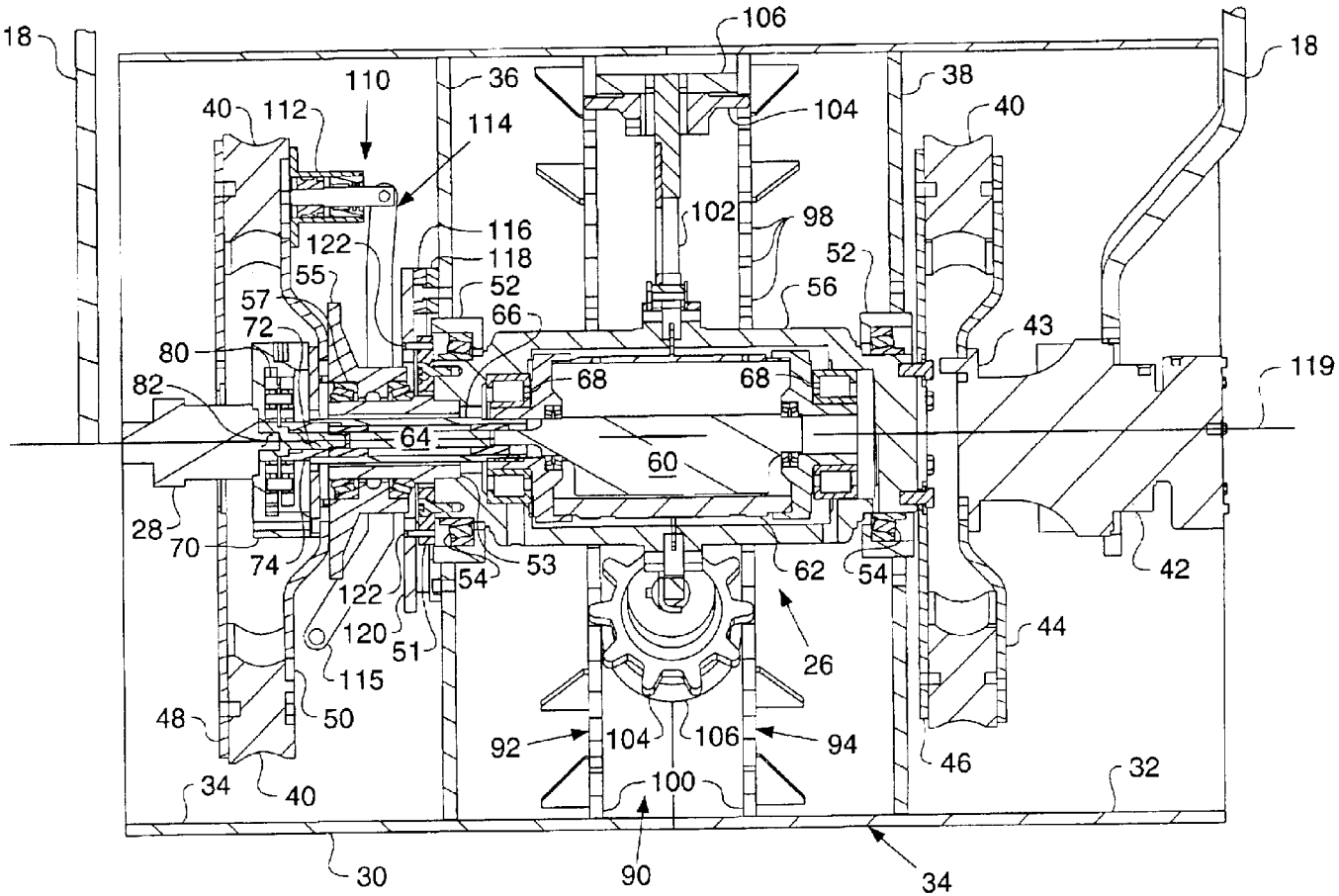
FIG. 2 shows an axial cross section view taken along line 2—2 through a compacting drum of the work machine of FIG. 1, showing an embodiment of the present invention.

In as much as, the front drum 14 and the rear drum 16 are structurally and operatively similar. The description, construction and elements comprising the front drum 14 will now be discussed in detail and applies equally to the rear drum 16. Referring to FIG. 2, the front drum 14 includes a vibratory mechanism 26 that is operatively connected to a vibe motor 28. The vibe motor 28 is operatively connected, as by fluid conduits and control valves or electrical conductors and switches neither of which are shown, to the first power source 20.

The front drum 14 is a split drum 15 that includes a first and a second drum section 30,32. Each of the first and second drum sections 30,32 is made up of an outer shell 34 that is manufactured from a steel plate that is rolled and welded at the joining seam. A bulkhead 36 is fixedly secured to the inside diameter of the outer shell 34 of the first drum section 30 as by welding and a bulkhead 38 is fixedly secured to the inside diameter of the outer shell 34 of the second drum section 32 in the same manner.

The first and second drum sections 30,32 are vibrationally isolated from the main frame 18 by rubber mounts 40. A propel motor 42 is positioned between the main frame 18 and the second drum section 32. For example, the propel motor 42 is connected to the main frame 18 and an output 43 of the propel motor 42 is connected to a mounting plate 44, by fasteners. The rubber mounts 40 are positioned between and connected to the mounting plate 44 and a support plate 46. The propel motor 42 additionally is operatively connected to the second power source 24 which, supplies a pressurized operation fluid or electrical current, to propel motor 42 for propelling the work machine 10. In a similar manner, the main frame is connected to a second mounting plate 48. Rubber mounts 40 are positioned between the second mounting plate 48 and a second support plate 50.

Support plate 46 is connected to one end of the vibratory mechanism 26. A bearing housing 52 is located in the radial center of each of the bulkheads 36,38. Bearings 54 are positioned within the bearing housings 52 and rotatably coaxially support a housing 56 of the vibratory mechanism 26. The end of the housing 56 opposite support plate 46 has a transition support 51 fastened thereto. A sleeve 53 is drivingly positioned within the transition support 51 and the housing 56. A trumpet housing 55 is connected to support plate 50 and has a pair of bearings 57 positioned therein that rotatably support the sleeve 53.

The vibratory mechanism 26 includes a first/inner eccentric weight 60 and a second/outer eccentric weight 62 that are connected to an inner shaft 64 and an outer shaft 66 respectively. The first/inner eccentric weight 60 and the second/outer eccentric weight 62 and rotatably supported within housing 56 by bearings 68. The outer shaft 66 is concentrically positioned within sleeve 53. Vibe motor 28 drives the inner and outer shafts 64,66 to supply rotational power to vibratory mechanism 26 thereby imparting a vibratory force on compacting drum 14.

More specifically as shown, a gearbox 70 has an inner drive shaft 72 and an outer drive/phase shaft 74. The inner drive shaft 72 is connected to the inner shaft 64, and the outer phase shaft 74 is connected to the outer shaft 66. The gearbox 70 includes a double planetary gear set 80, however other numbers of planetary gear sets may be used as well. An output shaft 82 of the motor 28 is connected to the gearbox 70 for supplying rotational input to the vibratory mechanism 26. An actuator (not shown) is connected to the gearbox 70 and provides rotational input to the double planetary gear set 80 to change the phase between the first eccentric weight 60 and the second eccentric weight 62. However, it should be understood that other arrangements may be used, in place of the gear box 80, to vary the phase relationship between the inner eccentric 60 and the outer eccentric 62 without departing from the gist of the present disclosure. For example, a slip clutch, a handle wheel or other arrangement (none of which are shown).

A differential arrangement 90 is positioned between the first and second drum sections 30,32. Differential arrangement 90 includes a internal ring sprocket 92 positioned axially inward from the bulkhead 36 of the first drum section 30 and an internal ring sprocket 94 positioned axially inward from the bulkhead 38 of the second drum section 32. Both of the internal ring sprockets 92,94 include a plurality of tooth elements 98 and a bearing surface 100. Bearing surface 100 is positioned on the radial face of the internal ring sprockets 92,94 between the plurality of tooth elements 98 and the outer drum shell 34 of the first and second drum sections 30,32. A floating frame 102 is connected to the housing 56 of the vibratory mechanism 26 as by fasteners. A drive sprocket 104 is rotatably connected to the floating frame 102 and meshingly engages the plurality of tooth elements 98 of the internal ring sprockets 92,94. A bearing disc 106 is positioned radially outward of the drive sprocket 98 and is rotatably supported by the floating frame 102. The bearing disc 106 also rides against the bearing surface 100 of the internal ring sprockets 92,94. In the embodiment shown there are a plurality of drive sprockets 98 and a plurality of bearing discs 106 equally radially spaced and rotatably supported by the floating frame 102.

Still referring to FIG. 2, a coupling arrangement 110 is positioned between the second support plate 50 and the bulkhead 36 of the first drum section 30 and about the outer shaft 66 that connects the gearbox 80 to the vibratory mechanism 26. The coupling arrangement 110 includes and actuator 112 connected to the second support plate 50. Actuator 112 is shown as being a spring actuated hydraulically deactivated cylinder, however it may be a solenoid operated actuator or other comparable linear actuator. One end of a throw out yoke 114 is operatively connected to the actuator 112 and the other end of the throw out yoke 114 is pivotally connected to the second support plate 50 opposite the actuator 112. It should be understood that the throw out yoke 114 includes a pair of yoke arms 115, only one shown in FIG. 2, spaced apart a predetermined distance so as to straddle the trumpet housing 55. A clutch plate 116 is spaced from the bulkhead 36 by a spacer 118 and connected thereto by fasteners. A pair of throw out bearings (not shown), one each rotatably connected to each of the yoke arms 115 and positioned perpendicular to an axis 119 of rotation of the drum 14. The throw out bearings press against a pressure plate 120 that is slidably supported by dowels pins 122 that are pressed into the transition plate 51.

Figure 3:
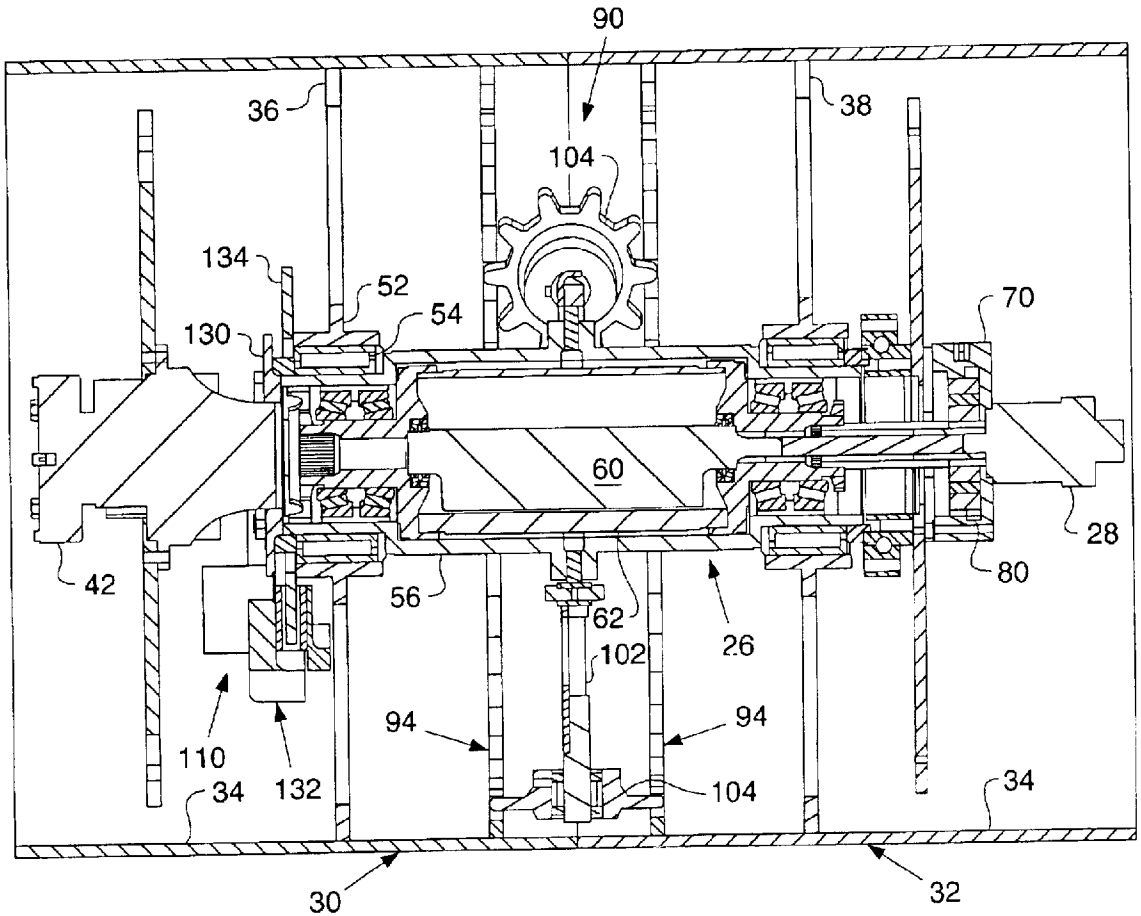
FIG. 3 shows an axial cross section view taken along line 2—2 through a compacting drum of the work machine of FIG. 1 showing an alternative embodiment of the present invention.

Referring now to FIG. 3, an alternate arrangement of the first compacting drum 14 is shown with like element numbers referencing like elements. The housing 56 of the vibratory mechanism 26 is rotatably supported by bearings 54. The bearings 54 are positioned in bearing housings 52, one of which is radially centered in each of the bulkheads 36,38. The differential arrangement 90 is positioned in the axial center of the drum 14 and is operatively connected to the first drum section 30 and the second drum section 32.

Propel motor 42 is connected to one end of the vibratory housing 56 with a mounting ring 130 positioned therebetween. The coupling arrangement 110 in this embodiment includes a caliper and brake arrangement 132 is connected to the support ring 130, as by fasteners, and rotates therewith. A rotor plate 134 is connected to the bearing housing 52 of the first drum section 30. It should be understood in the embodiment shown in FIG. 3 the caliper and brake arrangement 132 and rotor plate 134 may be positioned in a variety of different positions and still achieve the desirable functional attributes. For example, the caliper and brake arrangement 132 may be attached to the housing 56 of the vibratory mechanism 26 between the bulkheads 36,38. While the rotor plate 134 being attached to the bearing housing 52 of either the first or second drum sections 30,32. Another option would be to mount the caliper and brake arrangement 132 to the floating frame 102 and have the rotor plate 134 attached to and rotatable with one of the drive sprockets 104.

Figure 4:
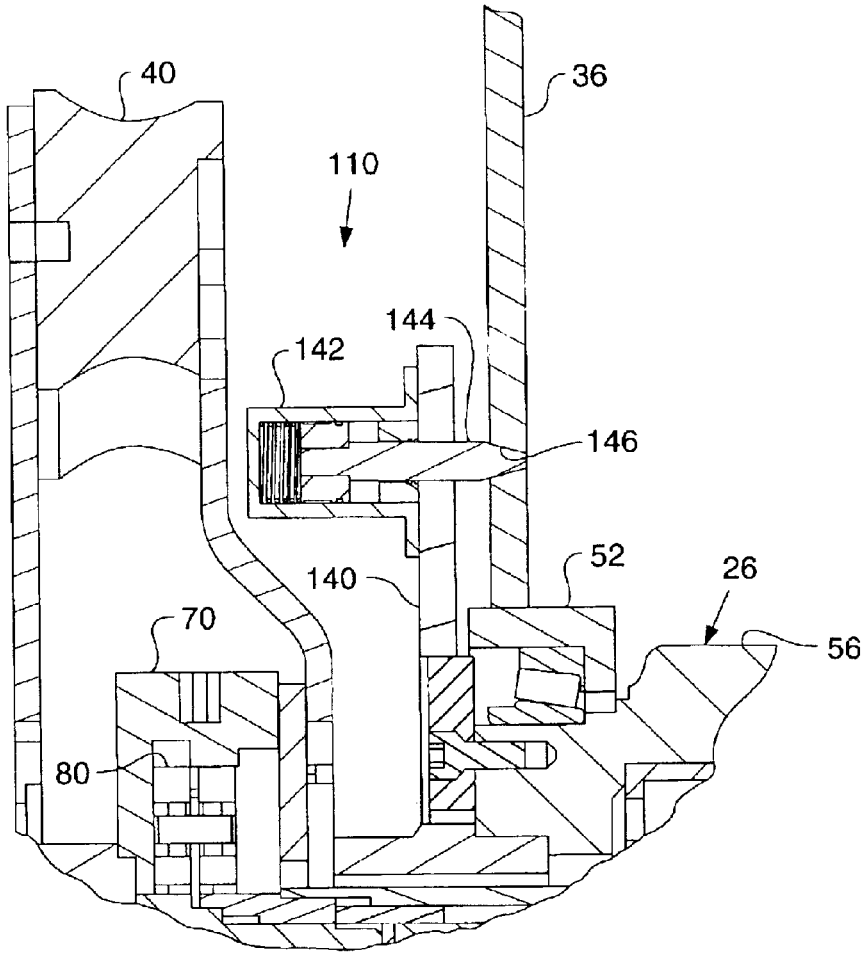
FIG. 4 shows an alternative embodiment of a coupling arrangement of the present invention.

Referring now to FIG. 4, another alternative for the coupling arrangement 110 is shown. A mounting member 140 is fastened to one end of the housing 56 of the vibratory mechanism 26. An actuator 142 is connected to the mounting member 140 radially outward from the housing 56. Actuator 142 is a spring extended hydraulic cylinder that includes a tapered locking portion 144 extending therefrom. Tapered locking portion 144 engages with at least one aperture 146 located in the bulkhead 36 of the first drum section.

INDUSTRIAL APPLICABILITY

In operation rotational/propel power is supplied to the first/front drum 14 by the propel motor 42. Power from the propel motor 42 is transmitted through the housing 56 of the vibratory mechanism 26 to at least one drive sprocket 104, of the differential arrangement 90, rotatably mounted to the floating frame 102. The drive sprocket 104 engages the internal ring sprocket 92 of the first drum section 30 and the second internal ring sprocket 94 of the second drum section 32.

The coupling arrangement 110 is used to control the relative movement between the first and second drum sections 30,32. The coupling arrangement 110 can be done either manually actuated through any of a number of known operator controlled configurations (not shown), such as hydraulically, electrically, or automatically through the use of a controller. Specifically, in the embodiments shown with the coupling arrangement 110 activated, either the first drum section 30 or the second drum section 32 is grounded to the housing 56 of the vibratory mechanism 26. The term "grounded to" in this description means that the relative motion between the housing 56 of the vibratory mechanism 26 and either the first drum section 30 or second drum section 32 is locked. With the coupling arrangement 110 activated the drive sprocket 104 is not allowed to rotate. This drives both the first and second drum sections 30,32 together and in the same direction. When the coupling arrangement 110 is deactivated the drive sprocket 104 is allowed to rotate thus causing the internal ring sprocket 92 to drive the first drum section 30 in one direction and the internal ring sprocket 94 to drive the second drum section 32 in an opposite direction or at a different rotational speed.

The split drum 15 provided offers an effective means of overcoming the undesirable characteristics of known unitary drum configurations. The split drum 15 described also provides for a simple machine control configuration wherein either a unitary drum or a split drum configuration can be employed with only a minor change in the base machine configuration. For example, a standard drum would require the hose routing, wiring and control configurations for a propel motor 42 and a vibe motor 28. The only modification for the split drum 15 design would be to add additional hose routing, wiring or control of the coupling arrangement 110.

What is claimed is:

1. A split drum rotatably supporting a main frame of a compacting work machine, said split drum comprising:

a first drum section;

a second drum section coaxially positioned with and adjacent to said first drum section; and a differential arrangement operatively connecting said first drum section and said second drum section.

2. The split drum of claim 1, wherein said differential arrangement includes an internal ring sprocket attached to said first drum section and an internal ring gear attached to said second drum section and at least one drive sprocket meshingly engaging said internal ring sprockets of said first and second drum sections.

3. The split drum of claim 2, wherein said drive sprocket is rotatably supported by a floating frame.

4. The split drum of claim 3, including a bearing disc positioned radially outward from and adjacent to said drive sprocket, said bearing disc contacting said internal ring sprocket of said first and second drum sections.

5. The split drum of claim 3, wherein said differential arrangement includes a plurality of drive sprockets equally spaced and rotatably supported by said floating frame.

6. The split drum of claim 5, wherein said floating frame is connected to a housing of a vibratory mechanism, said vibratory mechanism being coaxial with said first and second drum sections.

7. The split drum of claim 6, wherein said housing of said vibratory mechanism being operatively connected with a propel motor.

8. The split drum of claim 7 including a coupling arrangement grounding said housing of said vibratory mechanism and a one of said first drum section and said second drum section.

9. The split drum of claim 8, wherein said coupling arrangement includes a clutch, a pressure plate and a throughout yoke.

10. The split drum of claim 9, wherein said clutch is connected to a one of said internal ring sprocket and a bulkhead of a one of said first drum section and said second drum section, said pressure plate is slidably supported by said housing of said vibratory mechanism.

11. The split drum of claim 8, wherein said coupling arrangement includes a rotor plate and a caliper and brake arrangement.

12. The split drum of claim 11, wherein said caliper and brake arrangement is connected to a one of said housing of said vibratory mechanism and said first drum section and said second drum section.

13. The split drum of claim 8, wherein said coupling arrangement includes and actuator and a locking pin.

14. The split drum of claim 13, wherein said actuator is connected to said housing of said vibratory mechanism and said locking pin engages a one of a bulkhead and an internal ring sprocket positioned one inside of a drum shell of said first drum section and said second drum section.

* * * * *